US005547346A

United States Patent [19]

Kanzaki et al.

[11] Patent Number: 5,547,346

[45] Date of Patent: Aug. 20, 1996

[54] VARIABLE DISPLACEMENT COMPRESSOR

[75] Inventors: Shigeki Kanzaki; Masahiro Kawaguchi; Masanori Sonobe; Tomohiko Yokono, all of Kariya, Japan

[73] Assignee: Kabushiki Kaisha Toyoda Jidoshokki Seisakusho, Kariya, Japan

[21] Appl. No.: 331,563

[22] PCT Filed: Mar. 9, 1994

[86] PCT No.: PCT/JP94/00379

§ 371 Date: Oct. 28, 1994

§ 102(e) Date: Oct. 28, 1994

[87] PCT Pub. No.: WO95/24557

PCT Pub. Date: Sep. 14, 1995

[51] Int. Cl.[6] ..... F04B 1/26

[52] U.S. Cl. ..... 417/222.2; 92/12.2

[58] Field of Search ..... 417/222.2; 92/12.2

[56] References Cited

U.S. PATENT DOCUMENTS

| | | | |
|---|---|---|---|
| 4,867,648 | 9/1898 | Murayama | 417/222.2 |
| 5,100,301 | 3/1992 | Hidaka et al. | 417/222.2 |
| 5,145,326 | 9/1992 | Kimura et al. | 417/222.2 |
| 5,240,385 | 8/1993 | Nashiro et al. | 417/222.2 |

FOREIGN PATENT DOCUMENTS

| | | |
|---|---|---|
| 52-131204 | 11/1977 | Japan . |
| 58-162780 | 9/1983 | Japan . |
| 337378 | 2/1991 | Japan . |
| 3143725 | 6/1991 | Japan . |

OTHER PUBLICATIONS

English translation of a part of the International Search Report in Japanese.

*Primary Examiner*—Charles Freay
*Attorney, Agent, or Firm*—Brooks Haidt Haffner & Delahaunty

[57] ABSTRACT

In a housing 1, 2, a rotor 11 is secured to a drive shaft 6 and a sleeve 12 is supported movably. A rotary swash plate 14 is tiltably supported on the sleeve 12 and is coupled to the rotor 11. Coupled to the rotary swash plate 14 are pistons 8 which move in the respective bores 9. A fluid is supplied to each bore 9 from a suction chamber 20, and a fluid compressed by each piston 8 is discharged to a discharge chamber 21. A control valve 25 controls the difference between the pressure in the suction chamber 20 and the pressure in a crank chamber 5 to change the inclination angle of the rotary swash plate 14, so that the discharge displacement of a compressor becomes variable. In the housing 1, a spool 32 is movably provided while enclosing the drive shaft 6. With the spool 32 entered in the crank chamber 5, when the sleeve 12 engages with the spool 32, the movement of the rotary swash plate 14 is restricted to the position that sets the discharge displacement of the discharge chamber 21 to a predetermined restricted displacement. By supplying the pressure in the discharge chamber 21 via a pressure supply passage 35 to retract the spool 32 from the crank chamber 5, the rotary swash plate 14 is permitted to move to the position where the discharge displacement to the discharge chamber 21 becomes zero.

8 Claims, 4 Drawing Sheets

VARIABLE DISPLACEMENT COMPRESSOR

TECHNICAL FIELD

The present invention principally relates to a variable displacement compressor suitable for use in an air conditioning system in a vehicle.

BACKGROUND ART

A variable displacement compressor is used in air conditioning systems installed in vehicles for air-conditioning. Such type of compressor is disclosed in Japanese Unexamined Patent Publication No. 63-16177.

The publication discloses a compressor which is shown in FIG. 5 of the present application and to which attention should be directed. The compressor has a housing 51 in which a crank chamber 52 is formed. A drive shaft 53 is rotatably supported in the crank chamber 52. A rotor 54 is secured on the drive shaft 53, and a rotary swash plate 55 is rotatably and swingably supported on the drive shaft 53. The rotary swash plate 55 is coupled via a hinge mechanism 56 to the rotor 54. The hinge mechanism 56 consists of an elongated hole 54*a* provided in the rotor 54 and a pin 56*a*. The pin 55*a* is attached to the swash plate 55 and is engaged with the elongated hole 54*a*. The swash plate 55 is coupled to the rotor 54 and swingable within the range of the length of this elongated hole 54*a*. An undulation plate 57 is attached to the swash plate 55 with its rotation restricted.

A plurality of bores 58 are formed in the housing 51. A piston 59 is placed in each bore 58. The piston 59 is coupled to the undulation plate 57 and reciprocates within the corresponding bore 58 based on the undulation of the plate 57. A suction chamber 60 is formed adjacent to each bore 58 in the housing 51. A fluid (refrigerant) is supplied to each bore 58 from the suction chamber 60. Likewise, a discharge chamber 61 is formed adjacent to each bore 58 in the housing 51. The fluid compressed by the pistons 59 in the respective bores 58 is discharged into the discharge chamber 61. Formed in the housing 51 is a fluid passage 62 which communicates the crank chamber 52 with the suction chamber 60. Provided in the suction chamber 60 is valve means 63 which senses the pressure in the chamber 60 and adjusts the opening of the bleed fluid passage 62 in response to the pressure.

The thus constituted compressor functions as follows. As the valve means 63 operates in response to the suction pressure in the suction chamber 60, the opening of the bleed passage 62 is adjusted. At this time, the pressure in the crank chamber 52 varies from time to time by the blow-by gas leaking from each bore 58. This pressure change alters the force acting on the back of the associated piston 59 and the balancing point of the moment that acts on the rotary swash plate 55, thus changing the inclination angle of the swash plate 55 and the undulation plate 57. The stroke of each piston 59 changes due to the angular change, so that the compression displacement of the fluid in each bore 58 is changed, controlling the amount of the fluid led into the bore 58. The suction pressure in the suction chamber 60 is controlled so as to be a predetermined value by the mechanism which varies the compression displacement in this manner.

According to the aforementioned variable displacement type mechanism, as the suction pressure in the suction chamber 60 falls due to a decrease in the thermal load in the air conditioning system, the valve means 63 is operated to reduce the opening of the fluid passage 62. The pressure increase in the crank chamber 52 is accelerated to control the compression displacement of the compressor in the direction of reducing it. When the thermal load further decreases, the valve means 63 is operated to completely close the fluid passage 62, so that the pressure in the crank chamber 52 further rises. This further reduces the compression displacement.

Even in this case, the reduction of the compression displacement is restricted to a predetermined minimum value. This is because that in an extremely small displacement area where the compression displacement becomes zero or extremely small close to zero, no effective compression-oriented work is performed. The restoration of the compression displacement, which should be accomplished by the difference between the suction pressure in the suction chamber 60 and the pressure in the crank chamber 52, becomes thus practically impossible. In recent compressors in which the individual sliding portions in the compressors are required to be lubricated with the oil mist admixed in the refrigerant, the burning at the individual sliding portions and the reduction in durability of the compressors due to insufficiency of refrigerant (lubrication) can be pointed as the factors which restrict the minimum value of the variable compression displacement.

So long as the minimum compression displacement is restricted as mentioned above, when a vehicular air conditioning system including a compressor and evaporator is used in the environment of a cold place or the like, the operation of the compressor must be controlled properly to protect the sliding portions of the compressor against wear and prevent freezing of the evaporator. For example, the compressor should be properly stopped by cutting off the power transmission to the compressor by an electromagnetic clutch. The electromagnetic clutch coupled to the compressor is widely used as an essential component of the current vehicular air conditioning systems.

With the use of a vehicular air conditioning system that employs an electromagnetic clutch, however, the shock at the time the system is activated thereby affects the driving feeling of the vehicle. In addition, the alternator for supplying power to the electromagnetic clutch has a surprisingly low efficiency, increasing the engine load accordingly, which is not negligible, either. In other words, it is easily understood that the elimination of the electromagnetic clutch, if possible, can significantly reduce the weight of the vehicular air conditioning systems as well as can contribute to reducing the fuel consumption.

It is therefore an object of the present invention to ensure protection of the individual sliding portions of a compressor against wear and suppression of over-cooling or the like, while eliminating the electromagnetic clutch.

SUMMARY OF THE PRESENT INVENTION

To achieve the above object, the variable displacement compressor according to the present invention is provided with bores formed in a housing, and a crank chamber formed in the housing. A drive shaft is rotatably supported in the crank chamber. A rotor is secured to the drive shaft. A rotary swash plate is tiltably supported on the drive shaft and moves on the drive shaft in accordance with the change in the inclination angle of the rotary swash plate. The rotary swash plate is coupled to the rotor by a hinge mechanism. Coupled to the rotary swash plate are pistons which reciprocate in the bores as the rotary swash plate undulates while rotating. A suction chamber is provided in the bores for supplying a fluid thereto. A discharge chamber is provided to discharge the fluid compressed in the bores based on the movement of the pistons. A control valve is provided to regulate the pressure in the crank chamber. By adjusting the difference between the pressure in the suction chamber and the pressure in the crank chamber by the control valve, the inclination angle of the rotary swash plate can be changed. A movement restriction mechanism is provided to restrict the movement of the rotary swash plate due to a change in inclination angle to the position where the discharge displacement of the fluid to the discharge chamber from the bores is minimized. A restriction release mechanism is also provided which releases the restriction on the rotary swash plate by the movement restriction mechanism by leading the pressure in the suction chamber as a compression pressure to the movement restriction mechanism, allowing the movement of the rotary swash plate to the position where the discharge displacement of the fluid to the discharge chamber becomes zero.

DETAILED DESCRIPTION OF THE PRESENTLY PREFERRED EMBODIMENTS

A variable displacement compressor according to one embodiment of the present invention will now be described with reference to FIGS. 1 and 2. In this embodiment, the compressor constitutes one component of a vehicular air conditioning system.

Figure 1:
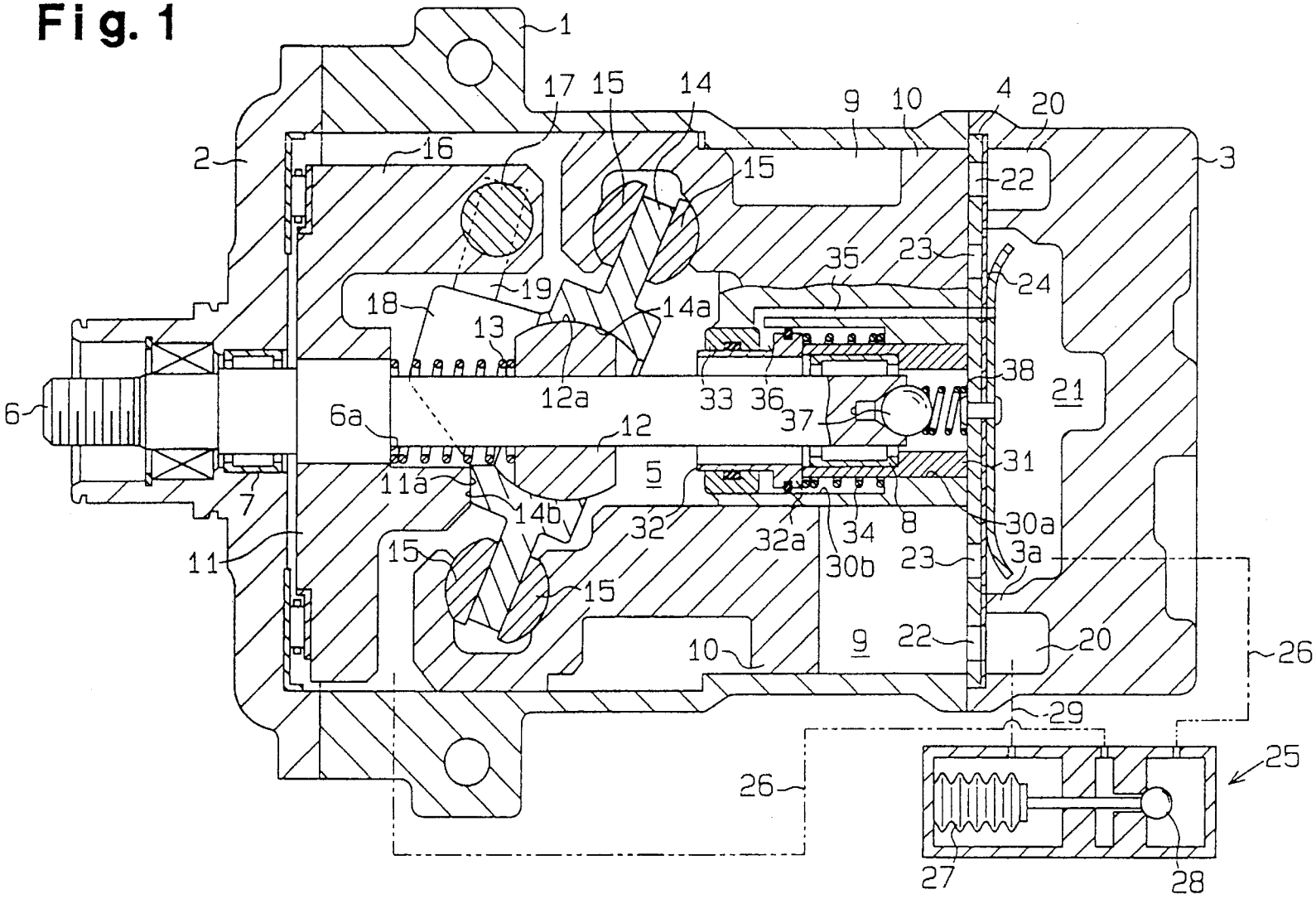
FIG. 1 is a cross-sectional view of a variable displacement compressor according to one embodiment of the present invention.
Figure 2:
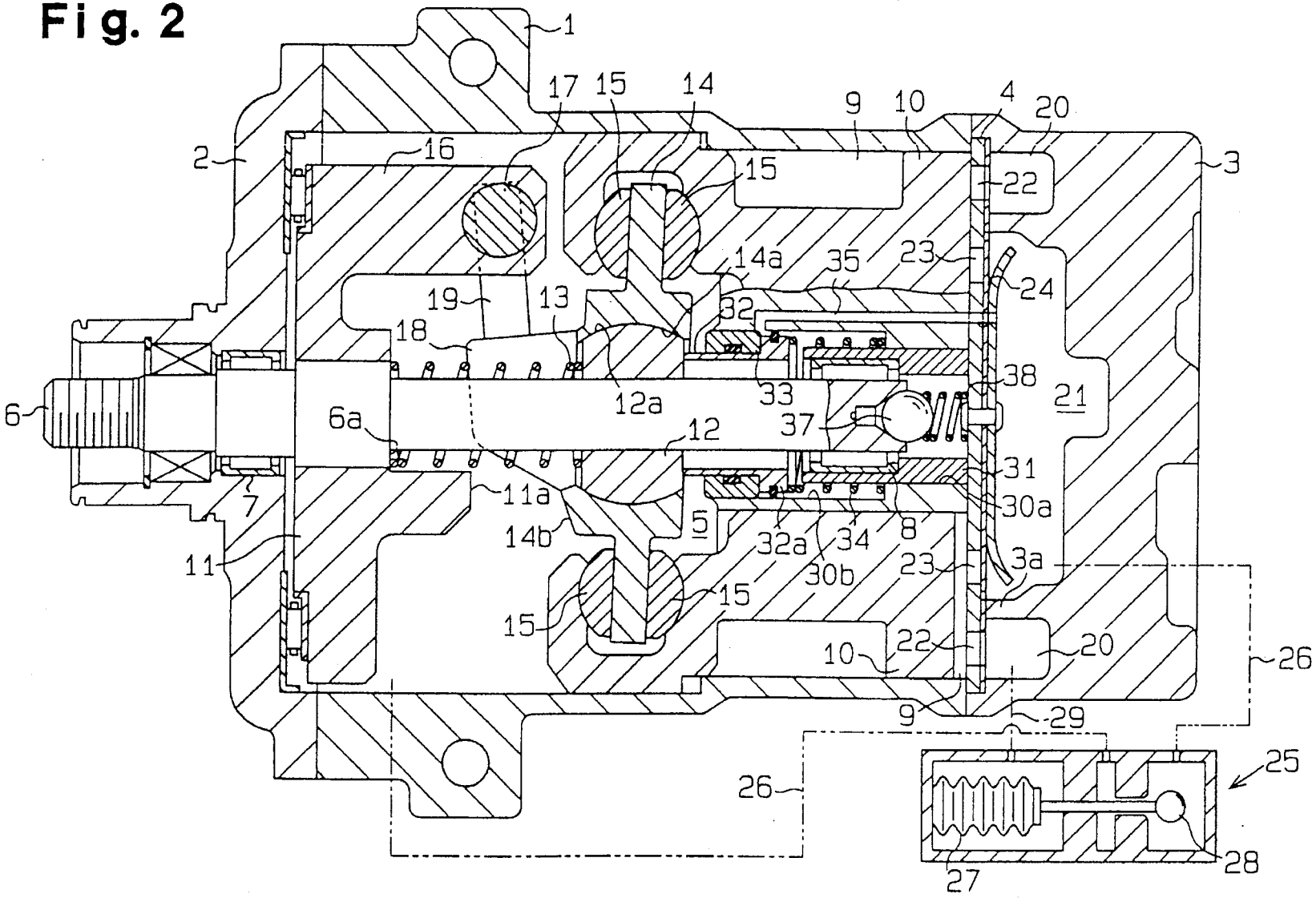
FIG. 2 is a cross-sectional view also showing the variable displacement compressor according to the embodiment of FIG. 1 but in a different operating condition.

As shown in FIGS. 1 and 2, the compressor has a cylinder block 1 with a front housing 2 attached to its front end. A rear housing 3 is attached via a valve plate 4 to the rear end of the cylinder block 1. A drive shaft 6 is accommodated in a crank chamber 5 defined by the cylinder block 1 and the front housing 2. This drive shaft 6 is rotatably supported by bearings 7 and 8. This drive shaft 6 is operably connected to an unillustrated engine. A plurality of bores 9 are provided in the cylinder block 1, in parallel to the drive shaft 6 to surround this shaft 6. A piston 10 is placed in each bore 9.

A rotor 11, which moves together with the drive shaft 6, is secured on this shaft 6 in the crank chamber 5. A sleeve 12 has a substantially spherical bearing surface 12*a* and is mounted rotatably and slidably on the drive shaft 6. Provided on the drive shaft 6 between a step portion 6*a* of the drive shaft 6 and the sleeve 12 is a spring 13 urging the sleeve 12 rearward (rightward in FIGS. 1 and 2). A rotary swash plate 14 is supported on the sleeve 12. This rotary swash plate 14 has a concave born spherical bearing face 14*a* which is to be fitted on the spherical bearing surface 12*a* of the sleeve 12 to make the rotary swash plate 14 tiltable under engagement of these faces 12*a* and 14*a*. Plural pairs of hemispherical shoes 15 are attached around this rotary swash plate 14. The rotary swash plate 14 is coupled to the pistons 10 via these pairs of shoes 15.

A restriction face 11*a* is formed on the inner side of the rotor 11, and a restricted face 14*b* opposing to the restriction face 11*a* is formed at the front side (left-hand side in FIGS. 1 and 2) of the rotary swash plate 14. As shown in FIG. 1, with the spring 13 compressed most, the restricted face 14*b* is abutted against the restriction face 11*a*, restricting the rotary swash plate 14 to a maximum inclining angle.

Formed on the periphery of the rotor 11 is an arm 16 which extends rearward. This arm 16, which constitutes a hinge mechanism, has a distal end portion to which a support shaft 17 extending perpendicular to the drive shaft 6 is rotatably attached. In association with this support shaft, a coupling portion 18 is formed at the front side of the rotary swash plate 14. Slidably attached to this coupling portion 18 is a guide pin 19, which extends in the radial direction of the cylinder block 1. The distal end of the guide pin 19 is secured to the support shaft 17.

Formed in the rear housing 3 are a suction chamber 20 and a discharge chamber 21, separated by a partition 3*a*. Suction ports 22 and discharge ports 23 open to the respective bores 9 are formed in the valve plate 4. Each suction port 22 and each discharge port 23 are opened or closed respectively by an inlet valve (not shown) and a discharge valve 24, in response to the reciprocation of the piston 9. A control valve 25 is provided in the rear housing 3 to control the pressure in the crank chamber 5. In association with this control valve 25, an air supply passage 26 is provided in the cylinder block 1 to provide communication between the discharge chamber 21 and the crank chamber 5.

This control valve 25 serves to adjust the opening of the air supply passage 26 in response to the pressure in the suction chamber 20. This valve 25 has a bellows 27 and a valve 28 coupled to the bellows 27. A gas under a predetermined pressure is sealed within the bellows 27. A passage 29 couples the suction chamber 20 to the chamber containing the bellows 27 in valve 25. As the bellows 27 expands or contracts in response to the pressure in the suction chamber 20, the valve 28 operates to control the opening of the air supply passage 26. Further, a restriction passage (not shown) is provided in the cylinder block 1 to connect the crank chamber 5 to the suction chamber 20. The gas in the crank chamber 5 is allowed to gradually escape to the suction chamber 20 via the restriction passage. As the pressure in the crank chamber 5 is controlled in accordance with the opening of the supply passage 26, the compression displacement (discharge displacement) of the compressor as a whole becomes variable.

A description will now be given of the movement restriction mechanism and restriction release mechanism which are of the structures most characteristic to this invention.

A small-diameter hole 30*a* and a large-diameter hole 30*b* are formed at the rear portion of the cylinder block 1 concentric with the axial center of the block. Both holes 30*a* and 30*b* extend through the cylinder block 1 in tandem with each other. A cylindrical stopper 31 is fitted in the small-diameter hole 30*a*. The aforementioned bearing 8 is disposed inside the stopper 31 to support the rear end portion of the drive shaft 6. A hollow spool 32 is slidably fitted in the large-diameter hole 30*b*. A flange 32*a* at the rear end of the spool 32 is fitted in the large-diameter hole 30*b* via a seal element. A bushing 33 is fitted in the opening of the large-diameter hole 30*b* open to the crank chamber 5. The body portion of the spool 32 is fitted in the bushing 33 via a seal element. A coil spring 34 intervenes between the flange 32*a* and the step portion between the holes 30*a* and 30*b*. The spool 32 is usually urged forward (leftward in FIGS. 1 and 2) by the spring 34. The axial movement of the spool 32 is restricted by the stopper 31 and the bushing 33. FIG. 2 shows the front end portion of the spool 32 moved into the crank chamber 5. Under this situation, the front end of the spool 32 is abuttable on the sleeve 12. When the sleeve 12 abuts on the spool 32, the rotary swash plate 14 is caused to have an inclining angle that ensures a compression displacement (discharge of a predetermined minimum. Thus spool 32 and coil spring 34 constitute a movement restriction mechanism of the present invention.

Formed between the individual bores 9 in the cylinder block 1 is a pressure supply passage 35, which extends through the block 1 and the valve plate 4 and constitutes the main portion of a restriction release mechanism. An annular compression chamber 36 is formed between the flange 32*a* of the spool 32 and the bushing 33. This compression chamber 36 is connected via the pressure supply passage 35 to the discharge chamber 21. So long as a compression operation is performed by each piston 10, the discharge pressure of the discharge chamber 21 is supplied via the pressure supply passage 35 to the compression chamber 36. As the spool 32 moves rearward by the action of the supplied pressure, the distal end portion of the spool 32 retracts into the large-diameter hole 30*b* from the crank chamber 5. A ball 37 is attached to the rear end of the drive shaft 6, with a coil spring 38 intervening between the ball 37 and the valve plate 4. Both members 37 and 38 are urging elements for restricting the movement of the drive shaft 6 and its associated members in the axial direction.

In the thus constituted compressor, when the compressor and the engine are both inactive, the discharge pressure of the discharge chamber 21 is not supplied via the pressure supply passage 35 to the compression chamber 36 due to the pressure balance in the compressor. That is, the restriction release mechanism is not activated. The spool 32 is pressed forward by the urging force of the coil spring 34 and its distal end portion enters the crank chamber 5. In this state, the spool 32 restricts the movement of the sleeve 12. As a result, the rotary swash plate 14 is held at the small inclining angle for allowing the discharge displacement of the compressor as a whole to be the minimum restricted displacement.

When the drive shaft 6 rotates from this state in response to the activation of the engine, the compressed refrigerant is discharged to the discharge chamber 21 from each bore 9 by the compressing action of each piston 10 based on the inclining angle of the rotary swash plate 14. When the discharge pressure is then supplied to the compression chamber via the pressure supply passage 35, the spool 32 moves rearward against the urging force of the coil spring 34 and its front end portion retracts into the large-diameter hole 30*b* from the crank chamber 5. That is, at this point of time, movement of the sleeve 12 corresponding to the direction of further reducing the discharge displacement of the compressor is completely permitted. The rotary swash plate 14 supported by the sleeve 12 is controlled within a freely variable range based on the action of the control valve 25 in accordance with the cooling load of the air conditioning system.

In other words, when the cooling load further decreases in accordance with the environmental conditions of the vehicle, requiring no cooling, the spool 32 retracts into the large-diameter hole 30*b*. This retraction releases the restriction on the movement of the sleeve 12. Accordingly the sleeve 12 and the rotary swash plate 14 are permitted to be displaced to the level for keeping the discharge displacement of the compressor zero based on the action of the control valve 25. Consequently, the compression operation by each piston 10 is stopped. When the compressor actually stops functioning in the above manner, the discharge pressure supplied to the compression chamber 36 via the pressure supply passage 35 also gradually decreases. When the urging force of the coil spring 34 acts again on the spool 32 against the hydraulic pressure acting on the spool 32, the distal end portion of the spool 32 moves toward the crank chamber 5 again. As the sleeve 12 engages the spool 32, the rotary swash plate 14 is forcibly returned to the position where the discharge displacement of the compressor becomes a predetermined minimum. When the rotary swash plate 14 is held at an inclining angle in the above manner so that the compression action restarts, the spool 32 retracts into the large-diameter hole 30*b* immediately in response to the recovery of the discharge pressure. As long as the condition for requiring no cooling continues, therefore, the discharge displacement of the compressor is kept between zero and a very small level close to zero. As a result, overcooling and power consumption due to operation of the compressor are suppressed and simultaneously, the lubricating oil is supplied to the individual portions based on the minimum compression operation, thus protecting the individual sliding portions of the compressor against wear.

Figure 4:
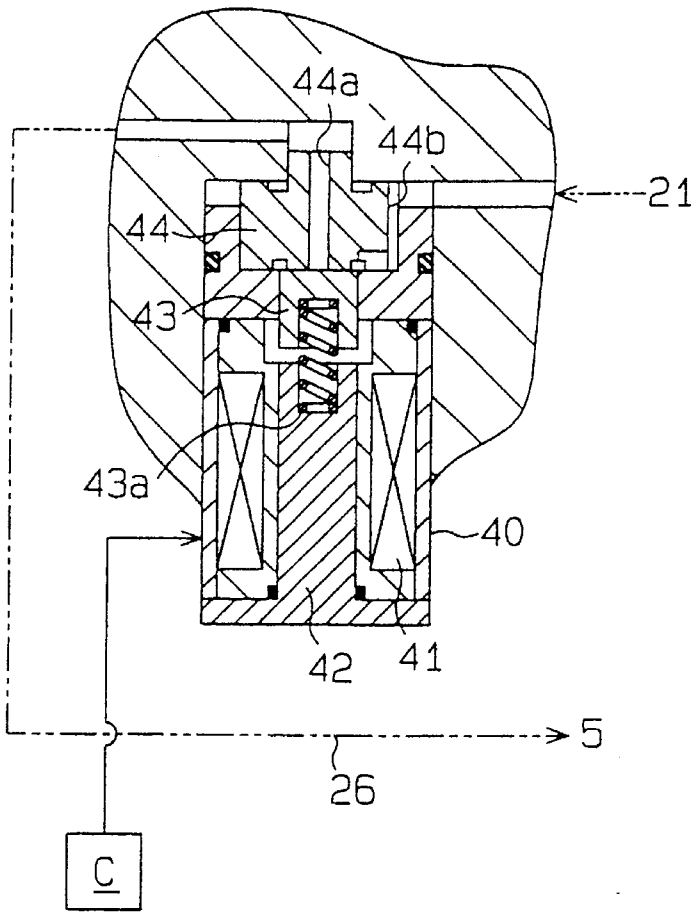
FIG. 4 is also a cross-sectional view of the control valve of FIG. 3 showing a different operating condition.
Figure 3:
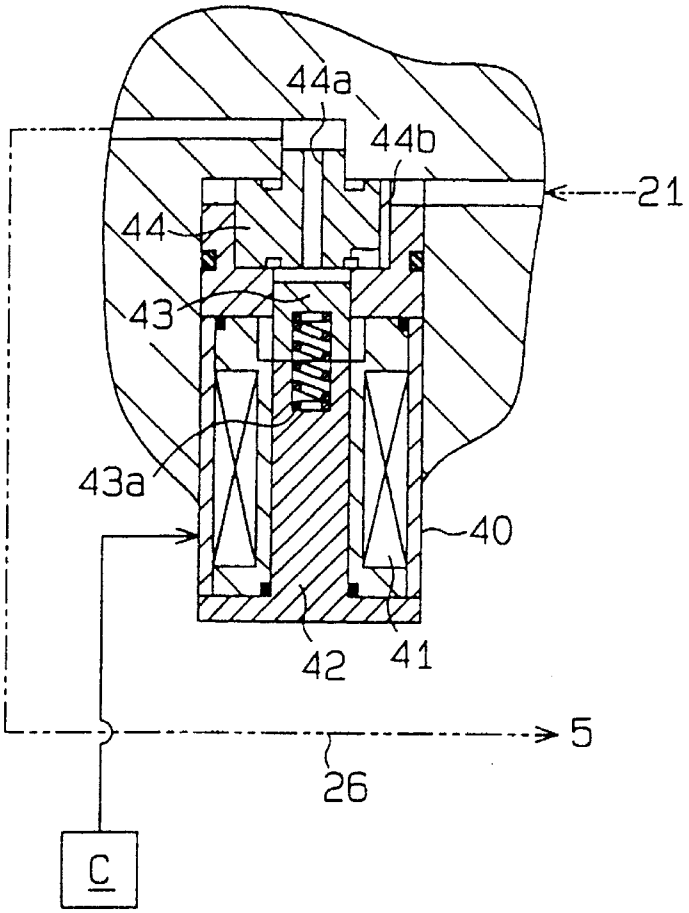
FIG. 3 is a cross-sectional view of a control valve according to another embodiment of this invention.

The present invention is not limited to this embodiment. For example, an electromagnetic valve 40 as shown in FIGS. 3 and 4 may be used as the control valve. This electromagnetic valve 40 has a solenoid 41 supported on a fixed iron core 42. The fixed iron core 42 is provided with a movable iron core 43 which can approach the fixed iron core 42 via a spring 43*a*. A valve 44 is disposed in the vicinity of the upper end of the movable iron core 43. The valve 44 has a through hole 44*a* extending along the axial direction, and a cutaway groove 44*b* on the circumference, extending in the axial direction. The crank chamber 5 side of the air supply passage 26 is connected to the through hole 44*a*, and the discharge chamber 21 side of the air supply passage 26 is connected to the cutaway groove 44*b*. As the movable iron core 43 is attracted to the fixed iron core 42 when the solenoid 41 of the electromagnetic valve 40 is energized, the discharge chamber 21 is allowed to communicate with the air supply passage 26 via the cutaway groove 44*b* and the through hole 44*a*, opening this passage 26. When the movable iron core 43 is spaced from the fixed iron core 42 when the solenoid 41 is de-energized, the communication between the through hole 44*a* and the air supply passage 26 is interrupted, closing the air supply passage 26. By selectively opening and closing the supply passage 26 in this manner, the pressure in the crank chamber 5 is controlled so that the discharge displacement of the compressor becomes variable.

This electromagnetic valve 40 intermittently opens the air supply passage 26 in accordance with the suction pressure or the like to finely control the pressure in the crank chamber 5, thus allowing the discharge displacement of the compressor to be continuously variable.

When it is desired to activate the compressor, the air supply passage 26 is opened by the electromagnetic valve 40 to set the discharge displacement of the compressor to 100%. When it is desired not to activate the compressor, the air supply passage 26 is closed to set the discharge displacement of the compressor to 0% or a value close to 0%. It is possible to perform control in such a manner that the discharge displacement may not assume an intermediate value between 100% and 0%. In this case, the control of the electromagnetic valve 40 becomes simpler.

Figure 5:
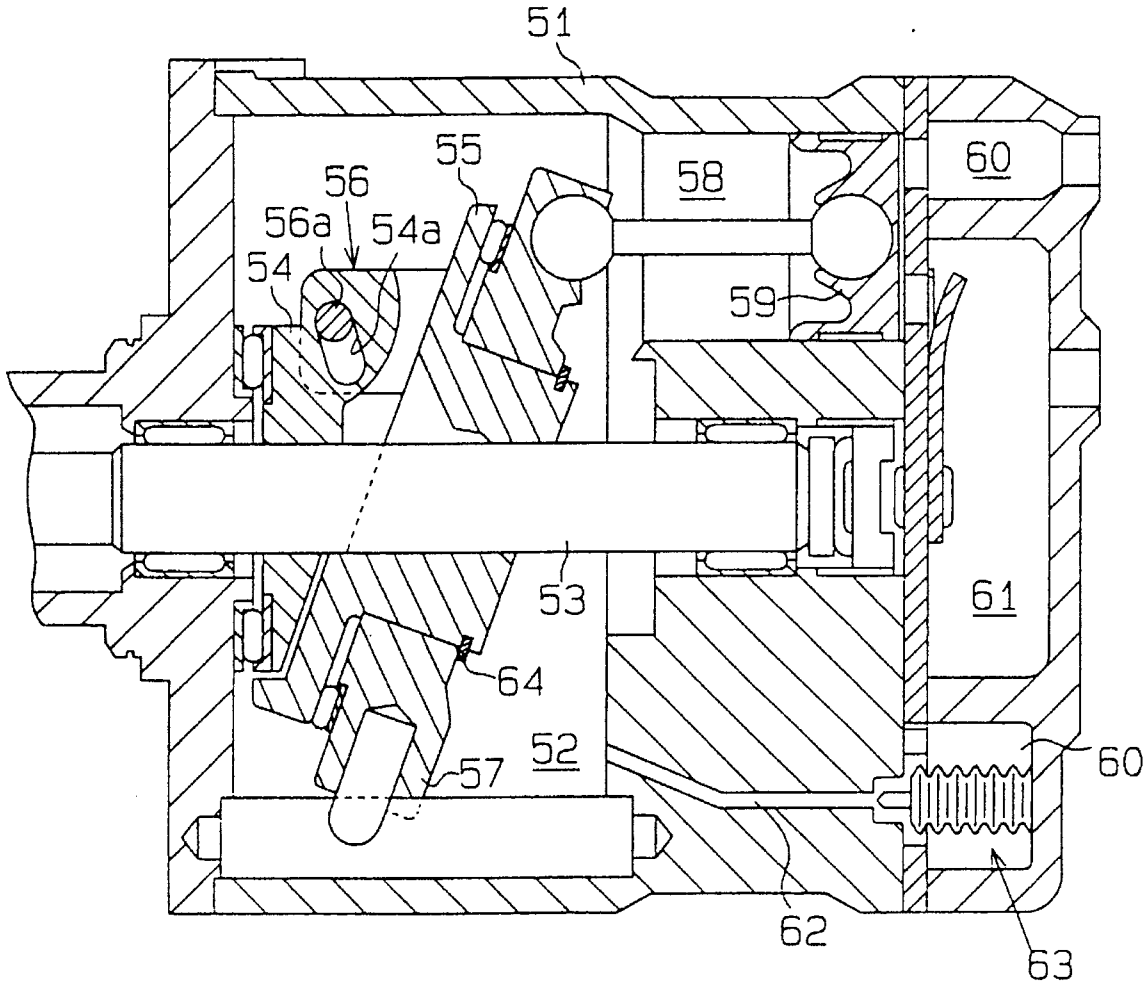
PRIOR ART Fig. 5
FIG. 5 is a cross-sectional view showing the variable displacement compressor according to the prior art.

Further, the aforementioned electromagnetic valve 40 may be provided as the control valve in the fluid passage 62 that communicates the crank chamber 52 with the suction chamber 60 as in the prior art shown in FIG. 5.

Furthermore, although the rotary swash plate 14 is urged via the sleeve 12 in the above-described embodiment, the rotary swash plate may be urged directly by the movement restriction mechanism without intervening the sleeve 12.

Industrial Applicability

The variable displacement compressor according to this invention can eliminate the use of an electromagnetic clutch, which controls the input from the power source, for controlling the driving of the compressor. This invention can also contribute to reducing the weight of the compressor and reducing the load of the power source. Further, it is possible to prevent overcooling or freezing of the evaporator due to overcooling in the air conditioning system, which has this compressor as one component, as well as, burning or the like in the compressor due to insufficient refrigerant (lubricating oil).

We claim:

1. A variable displacement compressor comprising a swash plate tiltably supported on a rotary drive shaft in a crank chamber in a housing, said swash plate being arranged to move in the axial direction of the drive shaft to tilt within a range defined between a maximum inclined position and an upright position, said swash plate being coupled to a piston capable of reciprocating in a cylinder bore in accordance with an undulating movement of said swash plate, whereby gas supplied to said cylinder bore from a suction chamber is compressed by said piston and discharged to a discharge chamber, and the volume of the gas discharged to said discharge chamber is determined by the inclined position of said swash plate, said tilting range of said swash plate including a predetermined minimum inclined position adjacent to the upright position where the volume of discharged gas to said discharge chamber from said cylinder bore is a predetermined minimum above zero;

a rotor secured to said drive shaft;

hinge means for connecting said swash plate with said rotor;

means for controlling the pressure in said crank chamber whereby the inclined position of said swash plate is altered in accordance with the difference between the pressures in said suction chamber and said crank chamber;

means for restricting the axial movement of said swash plate in the minimum displacement direction replacing the upright position of the tilting range with said predetermined minimum inclined position; and means for releasing said restriction of the axial movement of said swash plate by introducing the pressure in said discharge chamber to said restricting means to permit driving said swash plate between said maximum inclined position and said upright position.

2. The compressor as set forth in claim 1, wherein said means for restricting the axial movement of said swash plate includes:

a spool movably coupled to said housing; and a spring for biasing said spool toward abutting against said swash plate.

3. The compressor as set forth in claim 2, wherein said means for releasing said restriction includes:

an operation chamber operatively coupled to said spool for urging said spool against the force of said spring when the pressure in said operation chamber increases; and a pressure passage connecting said operation chamber with said discharge chamber to supply compressed fluid from said discharge chamber to said operation chamber.

4. The compressor as set forth in claim 1, wherein said means for controlling the pressure in said crank chamber includes a control valve for adjusting said pressure in said crank chamber in accordance with the pressure in said suction chamber.

5. The compressor as set forth in claim 4, wherein said swash plate tilts between said maximum inclined position and the upright position or the predetermined minimum inclined position in accordance with the pressure in said crank chamber.

6. The compressor as set forth in claim 5, wherein said means for controlling the pressure in said crank chamber includes an electromagnetic valve which is selectively energized and deenergized for adjusting the pressure in said crank chamber.

7. A variable displacement compressor comprising a swash plate tiltably supported on a rotary drive shaft in a crank chamber in a housing, said swash plate being arranged to move in the axial direction of said drive shaft to tilt within a range defined between a maximum inclined position and an upright position, said swash plate being coupled to a piston capable of reciprocating in a cylinder bore formed in said housing in accordance with an undulating movement of said swash plate, whereby gas supplied to said cylinder bore from a suction chamber is compressed by said piston and discharged to a discharge chamber, and the volume of the gas discharged to said discharge chamber is determined by the inclined position of said swash plate, said tilting range of said swash plate including a predetermined minimum inclined position adjacent to the upright position where the volume of discharged gas to said discharge chamber from said cylinder bore is a predetermined minimum above zero;

a rotor secured to said drive shaft;

hinge means for connecting said swash plate with said rotor;

a control valve for adjusting the pressure in said crank chamber in accordance with the pressure in said suction chamber, wherein the inclined position of said swash plate is altered in accordance with the difference between the pressure in said crank chamber and said suction chamber;

a spool movably coupled to said housing;

a spring for biasing said spool against said swash plate for restricting the axial movement of said swash plate in the minimum displacement direction to forceably replace the upright position of the tilting range with said predetermined minimum inclined position;

an operation chamber operatively coupled to said spool for urging said spool in the direction against the force of said spring when the pressure in said operation chamber is in excess of the force of said spring; and a pressure passage connecting said operation chamber with said discharge chamber to supply compressed fluid from said discharge chamber to said operation chamber, wherein the restriction of the axial movement of said swash plate is released to permit driving said swash plate between said maximum inclined position and said upright position.

8. The compressor as set forth in claim 7, wherein said control valve comprises an electromagnetic valve which is selectively energized and deenergized for adjusting the pressure in said crank chamber.

* * * * *

UNITED STATES PATENT AND TRADEMARK OFFICE

CERTIFICATE OF CORRECTION

PATENT NO. : 5,547,346

DATED : August 20, 1996

INVENTOR(S) : Kanzaki et al

It is certified that error appears in the above-indentified patent and that said Letters Patent is hereby corrected as shown below:

Column 1, line 21, "55a" should read --56a--; line 50, change "by the" to --due to the--.

Column 3, line 32, after "operating condition;" insert --and--; line 63, delete "born".

Column 5, line 9, after "discharge" insert --displacement of the compressor--.

Signed and Sealed this

Fourth Day of February, 1997

*Attest:*

*Attesting Officer*

BRUCE LEHMAN

*Commissioner of Patents and Trademarks*